US009140134B2

(12) United States Patent
Boening et al.

(10) Patent No.: US 9,140,134 B2
(45) Date of Patent: Sep. 22, 2015

(54) GUIDE VANE FOR A TURBO-COMPRESSOR, GUIDE VANE ARRANGEMENT, TURBO-COMPRESSOR, MOTOR VEHICLE AND METHOD

(75) Inventors: Ralf Boening, Reiffelbach (DE); Holger Faeth, Fussgoenheim (DE)

(73) Assignee: Continental Automotive GmbH, Hannover (DE)

( * ) Notice: Subject to any disclaimer, the term of this patent is extended or adjusted under 35 U.S.C. 154(b) by 779 days.

(21) Appl. No.: 13/496,001

(22) PCT Filed: Sep. 13, 2010

(86) PCT No.: PCT/EP2010/063346

§ 371 (c)(1),
(2), (4) Date: Mar. 14, 2012

(87) PCT Pub. No.: WO2011/029921

PCT Pub. Date: Mar. 17, 2011

(65) Prior Publication Data

US 2012/0177482 A1 Jul. 12, 2012

(30) Foreign Application Priority Data

Sep. 14, 2009 (DE) ..... 10 2009 041 027

(51) Int. Cl.
*F01D 17/16* (2006.01)

(52) U.S. Cl.
CPC ..... *F01D 17/165* (2013.01); *F05D 2220/40* (2013.01); *F05D 2240/301* (2013.01); *F05D 2250/71* (2013.01)

(58) Field of Classification Search
CPC ..... F01D 1/08; F01D 9/048; F01D 17/165; F01D 17/167; F05D 2240/121; F05D 2240/122; F05D 2250/713; F05D 2250/73; F05D 2220/40
USPC ..... 415/76, 159, 160, 163, 164, 165; 416/235, 237, 242, 223 A, 223 B
See application file for complete search history.

(56) References Cited

U.S. PATENT DOCUMENTS

| | | | | |
|---|---|---|---|---|
| 3,000,401 | A * | 9/1961 | Ringleb | 138/39 |
| 4,183,209 | A | 1/1980 | Kronogard | |
| 6,558,117 | B1 * | 5/2003 | Fukaya et al. | 415/164 |

(Continued)

FOREIGN PATENT DOCUMENTS

| | | | |
|---|---|---|---|
| AT | 34 044 | B | 8/1908 |
| AT | 34044 | B | 8/1908 |

(Continued)

OTHER PUBLICATIONS

International Search Report of PCT/EP2010/063346, Dated Aug. 1, 2011.

*Primary Examiner* — Dwayne J White
*Assistant Examiner* — Adam W Brown
(74) *Attorney, Agent, or Firm* — Laurence A. Greenberg; Werner H. Stemer; Ralph E. Locher

(57) ABSTRACT

A guide vane of a turbo-compressor has variable turbine geometry, in particular for a motor vehicle. The guide vane has a profile with a lower side, an upper side and a front edge. The guide vane is characterized by a nose which extends along the front edge of the vane, from the front edge of the vane to the upper side of the vane and forms a low pressure on the upper side of the vane when waste gas impacts the guide vane. A guide vane configuration, a turbo-compressor, a motor vehicle and a method for operating this type of turbo-compressor are further disclosed.

13 Claims, 4 Drawing Sheets

(56) References Cited

U.S. PATENT DOCUMENTS

| | | | |
|---|---|---|---|
| 2008/0260528 | A1 | 10/2008 | Weber et al. |
| 2009/0104023 | A1 | 4/2009 | Favray et al. |
| 2009/0160194 | A1 | 6/2009 | Clark |
| 2010/0329838 | A1 | 12/2010 | Greenblatt |

FOREIGN PATENT DOCUMENTS

| | | | |
|---|---|---|---|
| CN | 2864100 | Y | 1/2007 |
| DE | 1815291 | A1 | 7/1970 |
| DE | 2743110 | A1 | 3/1978 |
| DE | 4212878 | A1 | 3/1993 |
| FR | 2 282 548 | A1 | 3/1976 |
| FR | 2282548 | A1 | 3/1976 |
| GB | 750 305 | A | 6/1956 |
| WO | 2007/011355 | A1 | 1/2007 |
| WO | 2007059995 | A1 | 5/2007 |
| WO | 2009/053984 | A1 | 4/2009 |

* cited by examiner

GUIDE VANE FOR A TURBO-COMPRESSOR, GUIDE VANE ARRANGEMENT, TURBO-COMPRESSOR, MOTOR VEHICLE AND METHOD

BACKGROUND OF THE INVENTION

Field of the Invention

The present invention relates to a guide blade for a turbocharger. The present invention also relates to a guide blade arrangement, a turbocharger, a motor vehicle and a method for operating a turbocharger of said type.

DE 10 2007 018 618 A1 describes the generally known design of a turbocharger for increasing the power of an internal combustion engine of a motor vehicle, said turbocharger being composed substantially of a radial turbine, with a turbine wheel which is driven by the exhaust-gas flow of the internal combustion engine, and of a radial compressor, which is arranged in the intake tract of the internal combustion engine and serves for compressing fresh air, said radial compressor having a compressor wheel which is connected in a rotationally conjoint manner to the turbine wheel by a rotor shaft.

The rotational speed of the radial compressor and therefore the so-called charge pressure is predefined by the rotational speed of the turbine or, more precisely, by means of the exhaust-gas mass flow flowing through the turbine. The turbine is usually dimensioned for a medium rotational speed and a medium power range of the internal combustion engine. In this way, by virtue of the fact that the rotating parts of the turbocharger have a sufficiently low mass moment of inertia, fast response behavior of the turbocharger and therefore fast implementation of an acceleration demanded by the vehicle driver is attained. Secondly, the turbine is operated with high efficiency in a medium rotational speed and power range of the internal combustion engine. A problem with said configuration, however, is the full-load range of the internal combustion engine. In the full-load range, the rotational speed of the turbine can increase to such an extent that the bearing arrangement, which is already subjected to high rotational speed loading, of the rotor shaft is damaged, or the admissible charge pressure of the internal combustion engine is exceeded. This may result in severe damage to or even destruction of the internal combustion engine.

One option for controlling the rotational speed of the turbocharger and therefore the charge pressure of the compressor is the use of a turbocharger with a so-called variable turbine geometry (VTG). U.S. Pat No. 6,709,232 describes a VTG turbocharger of said type. A VTG turbocharger has a guide blade ring which radially surrounds the turbine wheel. The guide blades are fastened with the rotary axles thereof to a carrier ring. On the rear side of the carrier ring, the rotary axles of the guide blades have a guide journal which engages into an adjusting ring. All the guide blades are rotated simultaneously by means of the adjusting ring. The adjusting ring is moved either by means of an electric actuating motor or by means of a vacuum capsule. The direction and the flow speed of the exhaust gas impinging on the turbine wheel blade arrangement is controlled by means of the angle of incidence of the guide blades. A shallow angle of incidence of the guide blade results in a reduced inlet cross section for the exhaust gas. However, in order that the same exhaust-gas mass flow can pass into the turbine per unit of time, the flow speed of the exhaust gas must increase. Furthermore, the angle at which the exhaust-gas mass flow impinges on the turbine blade arrangement is greater when the guide blades are at a shallow angle than when the guide blades are set at a steep angle. Therefore, for the same exhaust-gas quantity, a flat angle of incidence of the guide blades leads to a higher turbine rotational speed than a steep angle of incidence. In this way, in the case of a VTG turbocharger, it is possible by means of the angle of incidence of the guide blades both to realize a high charge pressure very quickly, for example in the event of acceleration of a motor vehicle from a standstill, and also to realize a reduced charge pressure, for example during full-load operation of the internal combustion engine at a constant high speed. VTG turbochargers are very widely used in particular in diesel engines.

In the simplest case, as a guide blade profile, use is made of profiles with a straight profile central line and a symmetrical thickness distribution. The regulability of such guide blade profiles is good. However, the thermodynamic and fluid-dynamic efficiency of such profiles is limited, in particular in the starting range of the internal combustion engine. For this reason, to optimize thermodynamic and fluid-dynamic efficiency in VTG turbocharger technology, use is made of a wide variety of guide blade profile variants, for example with continuously curved profile central lines, profile central lines which are curved in sections, profiles with an asymmetrical thickness distribution, profiles with an S bend, etc. Depending on the design, these profile variants however have various disadvantages with regard to their regulability.

As a result of the impingement of exhaust-gas flow on the guide blades, there is a certain pressure distribution across the guide blade surface, which pressure distribution, depending on the angular position of the guide blades, exerts a moment on the guide blades which has an opening or closing action. Since mechanical systems are always afflicted with play to a certain extent, a non-defined angular position of the blades arises in the angular region of this moment reversal. This non-defined angular position must be avoided from a regulating technology aspect.

Furthermore, a closing moment caused by the flow impinging on the guide blades can lead to a self-boosting effect when the guide blades are nearly closed. That is to say, if the blades are already nearly closed, the flow speed of the exhaust gas increases owing to the reduced flow cross section. This in turn causes the closing moment to increase. In the worst case, the actuator for adjusting the angle of incidence of the guide blades can then no longer impart the force required for opening the guide blades, and the turbocharger rotational speed increases in an uncontrolled manner. Furthermore, the emergency running characteristics of a closing guide blade geometry of said type are extremely poor, for example because, in the event of a failure of the actuator, the turbine rotational speed and therefore the charge pressure on the compressor side increase in an uncontrolled manner.

The disadvantages just mentioned should therefore be eliminated to the greatest possible extent.

Against this background, it is the object of the present invention to provide an improved guide blade.

BRIEF SUMMARY OF THE INVENTION

Said object is achieved according to the invention by means of a guide blade having the features of patent claim 1 and/or by means of a guide blade arrangement having the features of patent claim 12 and/or by means of a turbocharger having the features of patent claim 13 and/or by means of a motor vehicle having the features of patent claim 14 and/or by means of a method having the features of patent claim 15.

Accordingly, the following is provided:

A guide blade of a turbocharger which is equipped with a variable turbine geometry, in particular for a motor vehicle, which guide blade has a profile with a blade underside, a blade top side and a blade leading edge, wherein a nose is provided which extends along the blade leading edge, which nose extends from the blade leading edge toward the blade top side and forms a negative pressure on the blade top side when exhaust gas impinges on the guide blade.

A guide blade arrangement for a turbocharger with adjustable turbine geometry, having: a multiplicity of guide blades according to the invention, a receptacle device for rotatably receiving the guide blades, wherein the guide blades are arranged in a circular configuration in the receptacle and wherein axes of rotation of the guide blades are arranged parallel to one another, an adjusting device for the uniform adjustment of an angle of incidence of the guide blades, wherein the adjusting device is designed as an adjusting ring, an actuator for adjusting the adjusting ring, and a coupling for connecting the actuator to the adjusting ring.

A turbocharger, in particular for a motor vehicle, having a guide blade arrangement according to the invention, which turbocharger has: a turbine housing, a turbine wheel which has a turbine blade arrangement and which is arranged in the turbine housing, a compressor housing, a compressor wheel which is arranged in the compressor housing, and a rotor shaft which connects the turbine wheel to the compressor wheel in a rotationally conjoint manner, wherein an angle at which an exhaust-gas impinges on the turbine blade arrangement can be adjusted by adjusting the angle of incidence of the guide blades.

A motor vehicle having a turbocharger of said type.

A method for operating a turbocharger of this type which has a multiplicity of guide blades according to the invention, wherein the multiplicity of guide blades are impinged on by a flow of exhaust gas in such a way that the exhaust gas impinges on a respective guide blade only in the region of the nose, as a result of which a negative pressure is formed in the region of the nose of each guide blade.

The idea on which the present invention is based is now inter alia that of providing a nose on the blade leading edge of the guide blade, which nose extends along the blade leading edge. Owing to the nose, a negative pressure is formed on the blade top side when a flow impinges on the blade leading edge. Said negative pressure results in a force which acts away from the blade top side.

It is therefore possible according to the invention to provide a guide blade which, over the entire operating range of a turbocharger with variable turbine geometry, is acted on by a force with a uniform direction of action. Said force generates a moment about an axis of rotation of the guide blade in the direction for opening the variable turbine geometry. In this way, an actuator of smaller dimensions can be used for adjusting the angle of incidence of the guide blades, as a result of which the turbocharger can be produced more cheaply overall. Since the force has the same direction of action over the entire operating range, the regulating characteristics of the turbocharger are significantly improved, because during operation of the turbocharger, there is no angular range with an undefined angle of incidence of the guide blades.

Furthermore, by means of the guide blades according to the invention, the emergency running characteristics of the turbocharger are also improved because, in the event of failure of the actuator, the guide blades automatically move, under the action of the force acting on the blade top side, in the direction for opening the variable turbine geometry.

Advantageous embodiments and refinements of the present invention will emerge from the further subclaims and from the description in conjunction with the figures of the drawing.

In a typical embodiment of the present invention, the nose forms a step-like cross-sectional widening of the profile. It is ensured in this way that the desired negative pressure is formed on the blade top side when the guide blade is impinged on by a flow of exhaust gas.

In a preferred embodiment of the present invention, the profile has a profile central line which defines a profile basic shape of the guide blade. Here, the profile central line runs from a first curvature central point of a first head radius in the region of the blade leading edge to a second curvature central point of an end radius in the region of a blade trailing edge situated opposite the blade leading edge. In this way, the basic shape of the profile of the guide blade can be produced with little expenditure, as a result of which the production costs of the guide blade according to the invention can be further reduced.

In a likewise preferred embodiment of the present invention, in the region of the nose, a third curvature central point of a second head radius is provided spaced apart from the profile central line. The third curvature central point is provided such that the blade leading edge is formed by the first and the second head radii. Here, the second head radius is greater than the first head radius. By means of the arrangement of the curvature central points, it is ensured that the shape of the nose can be defined using simple geometrical shapes, as a result of which the production costs of the guide blade according to the invention can likewise be reduced.

In a further preferred embodiment of the present invention, in the region of the step-like cross-sectional widening, the profile runs over the second head radius approximately perpendicular to the profile central line and merges into the profile basic shape. This ensures as fast as possible a transition from the large profile thickness of the nose to the smaller profile thickness of the profile basic shape. This also yields the greatest possible negative pressure on the blade top side, as a result of which a force acting away from the blade top side can be generated even at low exhaust-gas flow speeds. This increases the range of application of the guide blade according to the invention.

In a likewise preferred embodiment of the present invention, the third curvature central point is provided between the profile central line and the blade top side. The nose is provided in a front third of the profile with respect to the blade leading edge. This results in the greatest possible torque about the axis of rotation of the guide blade, as a result of which automatic opening of the variable turbine geometry is ensured even in the case of a low exhaust-gas mass flow.

In a further preferred embodiment of the present invention, the profile central line is a straight line or has a continuous curvature. In this way, the profile basic shape can be produced by means of simple, geometrically representable profile central lines, as a result of which the guide blades according to the invention can be produced more simply, and production costs are reduced.

In a likewise preferred embodiment of the present invention, an end edge of the nose is of sharp-edged design. This additionally improves the effect of the nose with regard to the generation of a negative pressure on the blade top side, as a result of which the exertion of an opening moment on the guide blade can be attained even at low flow speeds.

In a further preferred embodiment of the present invention, the nose has an extent, in the longitudinal direction of the profile proceeding from the blade leading edge, of up to 30% to 50%, preferably 30%, of a length of the profile. It is ensured in this way that the nose always generates an opening moment, and not a closing moment, about the axis of rotation of the guide blade.

The embodiments and refinements specified above may—where expedient—be combined with one another in any desired way.

The present invention will be explained in more detail below on the basis of the exemplary embodiments illustrated in the schematic figures of the drawing, in which:

DESCRIPTION OF THE INVENTION

Figure 1:
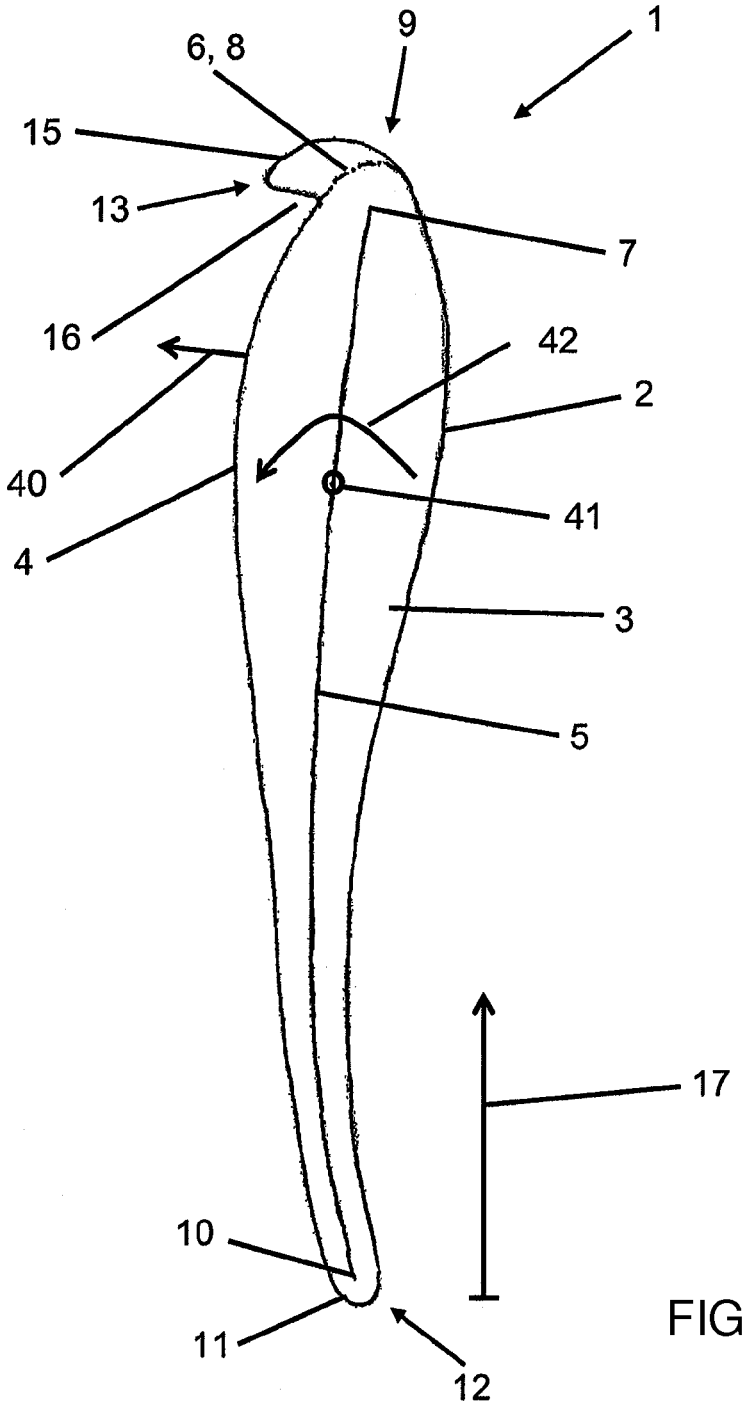
FIG. 1 shows a schematic sectional view of an embodiment of a guide blade according to the invention.

In the figures of the drawing—unless stated otherwise—identical components, elements and features have been denoted by the same reference numerals.

FIG. 1 shows a schematic sectional view of an exemplary embodiment of a guide blade according to the invention.

FIG. 1 firstly shows a guide blade 1 with a blade underside 2 and a blade top side 4. The blade underside 2 and the blade top side 4 form, together with a blade leading edge 9 and a blade trailing edge 12, the boundary of the profile 3 of the guide blade 1. The blade leading edge 9 constitutes an incident-flow edge of the profile 3. The guide blade 1 has a profile central line 5 of a profile basic shape 6. The profile basic shape 6 has a symmetrical thickness distribution. The profile central line 5 runs from a first curvature central point 7 of a first head radius 8 of the blade leading edge 9 to a second curvature central point 10 of an end radius 11 of the blade trailing edge 12. The profile central line 5 is formed here by a multiplicity of curvature central points of a multiplicity of circles laid tangentially on the profile basic shape 6. The profile central line 5 preferably has a continuous curvature. Alternatively, the profile central line 5 may also be formed by a straight line or by any desired other linear two-dimensional form. The profile 3 of the guide blade 1 furthermore has a step-like cross-sectional widening 13 in the form of a nose 13 which extends along the blade leading edge 9. The nose 13 runs from the blade leading edge 9, which is formed as the incident-flow edge, in the direction of the blade top side 4 to the blade trailing edge 12. The nose 13 is defined by a second head radius 15 at the blade leading edge 9. Here, the second head radius 15 is preferably greater than the first head radius 8. The curvature central point of the second head radius 15 does not lie on the profile central line 5. That is to say, in the region of the blade leading edge 9, the profile 3 of the guide blade deviates from the symmetrical thickness distribution of the profile basic shape 6. In a longitudinal direction 17 of the guide blade 1, the step-like cross-sectional widening 13 in the form of the nose 13 runs from the blade leading edge 9 as far as at most half way along the profile 3. The step-like cross-sectional widening 13 however preferably ends in the front third of the profile 3 with respect to the blade leading edge 9. The guide blade 1 furthermore has an axis of rotation 41 which is preferably arranged in a front third of the guide blade 1 in the longitudinal direction 17.

When a flow of exhaust gas from an internal combustion engine impinges on the guide blade 1 at the blade leading edge 9 formed as the incident-flow edge, a negative pressure 16 is formed on the blade top side 4 as a result of the nose 13. A force 40 resulting from said negative pressure 16 acts away from the blade top surface 4 and generates a torque 42 about the axis of rotation 41.

Figure 2:
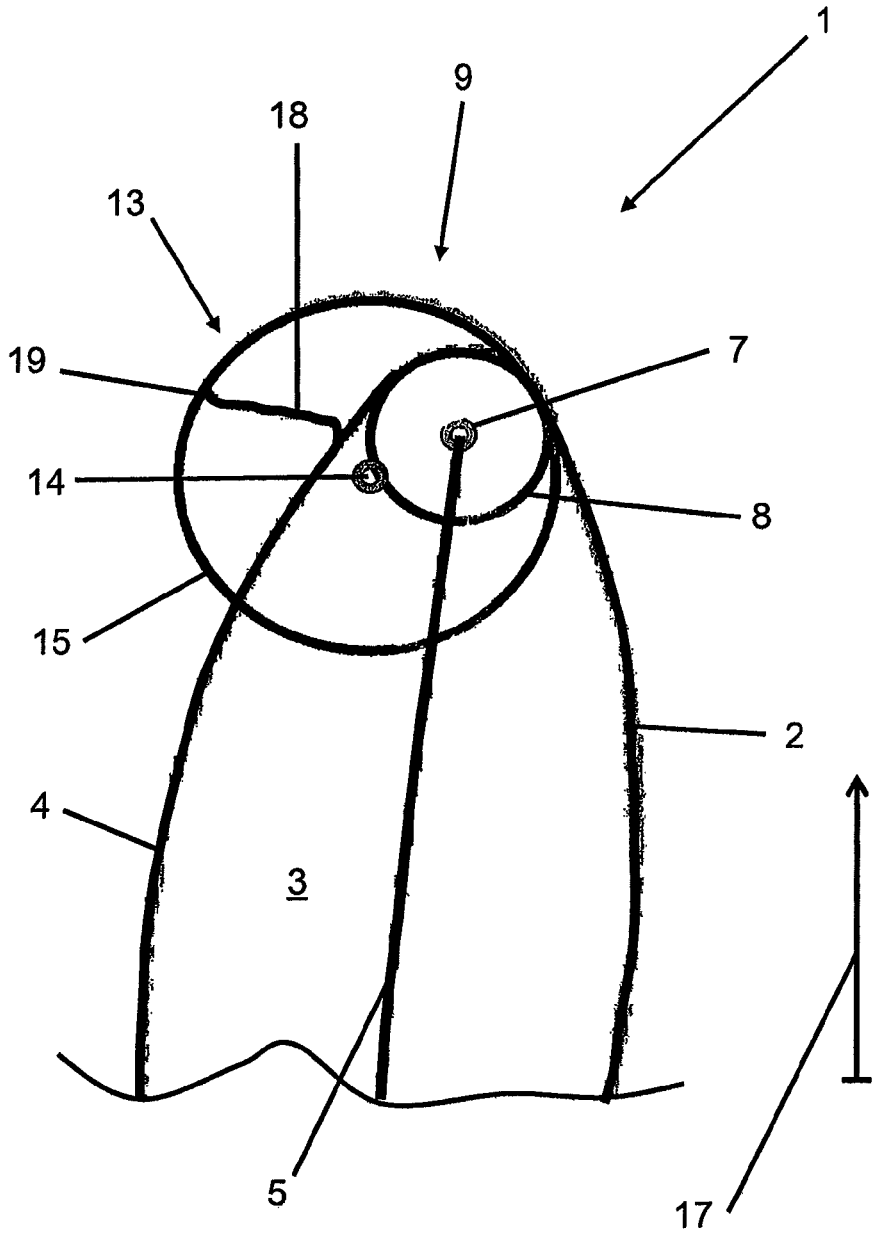
FIG. 2 shows a schematic, enlarged sectional view of the exemplary embodiment of the guide blade according to the invention illustrated in FIG. 1.

FIG. 2 illustrates a schematic, enlarged sectional view of the exemplary embodiment of the guide blade according to the invention illustrated in FIG. 1.

FIG. 2 shows, in an enlarged view, the blade leading edge 9 of the guide blade 1. The first head radius 8 with the first curvature central point 7 and the second head radius 15 with a third curvature central point 14 are illustrated, for clarity, as solid circles. The third curvature central point 14 is not arranged on the profile central line 5. The third curvature central point is preferably arranged between the profile central line 5 and the blade top side 4. With respect to the longitudinal direction 17 of the profile 3, the third curvature central point 14 is preferably arranged in the front third of the profile 3 in relation to the blade leading edge 9. The shape of the nose 13 is defined substantially by the second head radius 15. Since the third curvature central point 14 does not lie on the profile central line 5, the course of the profile 3 in the region of the blade leading edge 9 is defined both by the first head radius 8 and also by the second head radius 15. Proceeding from the blade underside 2, an outer contour of the profile 3 runs, via a portion 18, over the first head radius 8 and the second head radius 15 back to the blade top side 4. The portion 18 is in this case preferably formed perpendicular to the profile central line 5. The transition 19 from the second head radius 15 to the perpendicular portion 18 is preferably of sharp-edged design.

The fact that the portion 18 is formed perpendicular to the profile central line 5 and the transition 19 is of sharp-edged design results in a particularly abrupt transition from the step-like cross-sectional widening 13 to the profile basic shape. In this way, a force acting away from the blade top side 4 is generated even at low incident-flow speeds at the blade leading edge 9.

Figure 3:
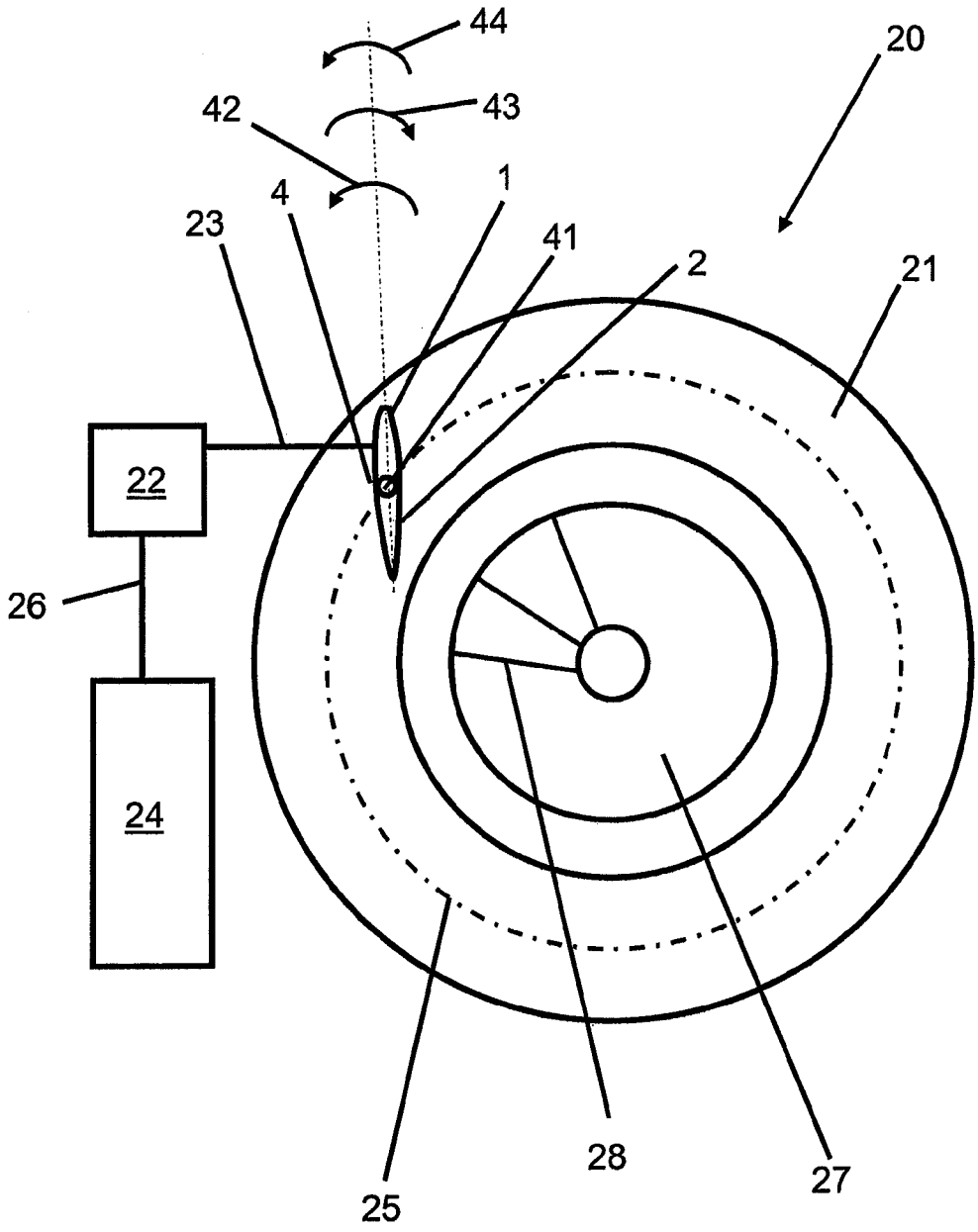
FIG. 3 shows a schematic view of an exemplary embodiment of a guide blade arrangement according to the invention.

FIG. 3 illustrates a schematic view of an exemplary embodiment of a guide blade arrangement according to the invention.

FIG. 3 firstly shows a guide blade arrangement 20 with a receptacle 21 for receiving a multiplicity of guide blades 1. For simplicity, FIG. 3 shows only one guide blade 1. The guide blades 1 have a bearing journal arranged in their axis of rotation 41, which bearing journal is arranged on a circular line 25 of the receptacle 21. FIG. 3 also shows an actuator 22, for example in the form of an electric actuator or a hydraulic cylinder. The actuator 22 is coupled to the guide blades 1 via a coupling 23 and an adjusting ring (not illustrated in FIG. 3). To simplify the illustration, in FIG. 3, the coupling 23 is connected directly to the guide blade 1. The actuator 22 is connected via a data line 26 to an engine controller 24, for example of a motor vehicle. Illustrated centrally in the guide blade arrangement 20 is a turbine wheel 27, with a turbine blade arrangement 28, of a turbocharger. Here, the guide blades 1 radially surround the turbine wheel 27.

The mode of operation of the guide blade arrangement 20 and of the guide blades 1 will be presented below.

All of the guide blades 1 can be pivoted about their axis of rotation 41 by means of the adjusting ring. Since the guide blades 1 radially surround the turbine wheel 27, the flow cross section available for the exhaust gas flowing to the turbine wheel 27 can be varied through the adjustment of the angle of incidence of the guide blades 1. The command to adjust the guide blade 1 in the direction 43, that is to say the "closing" direction, or in the direction 44, that is to say the "opening" direction, is imparted to the actuator 22 by means of the engine controller 24 as a function of the operating state of an internal combustion engine and a position of an accelerator pedal of the internal combustion engine.

When the guide blades 1 are closed, the flow cross section available for the exhaust gas is reduced. However, in order that the same exhaust-gas mass flow can flow through a reduced flow cross section, the flow speed increases. Furthermore, a closed position of the guide blades 1 yields a steep angle of impingement of the exhaust gas on the turbine blade arrangement 28. As a result, the rotational speed of the turbine wheel 27, and therefore the rotational speed of a compressor wheel of the turbocharger of the internal combustion engine, increases. As a result, the charge pressure and the power of the internal combustion engine increase. Said operating state of the guide blade arrangement 20 will arise for example during acceleration of a motor vehicle.

When the guide blades 1 pivot in the direction 44, that is to say as the guide blades 1 open, the flow cross section available for the exhaust gas is enlarged. The flow speed of the exhaust gas decreases, and the incident-flow angle at which the exhaust gas impinges on the turbine blade arrangement 28 becomes shallower. The rotational speed of the turbine wheel 27 and therefore the rotational speed of the compressor wheel and the charge pressure of the internal combustion engine fall. This operating state arises for example during constant high-speed driving of a motor vehicle under full load.

Since a negative pressure is generated on the blade top side 4 of the guide blades 1 by the step-like cross-sectional widening in the form of a nose of the guide blade profile, a torque 42 acts in the "opening" direction of the guide blades 1. In this way, it is achieved that the opening of the guide blades 1 is assisted by the torque 42 over the entire operating range of the turbocharger. The emergency running characteristics of a turbocharger equipped with such guide blades 1 according to the invention is thereby improved, because in the event of a failure of the actuator 22 or of the engine controller 24, the rotational speed of the turbine wheel 27 is automatically reduced as a result of an opening of the guide blades 1. Furthermore, since a negative pressure prevails on the blade top sides of the guide blades 1, and therefore an opening torque 42 is generated, over the entire operating range of the turbocharger, it is achieved that, in contrast to known guide blades which generate a closing torque, a situation is prevented in which a so-called self-boosting closing effect arises when the guide blades are nearly closed. Said effect arises in particular in the case of guide blades which generate a closing torque. In the case of such guide blades, as a result of the increased flow speed when the guide blades are nearly closed, the closing torque increases to such an extent that the actuator can possibly no longer provide the force required for opening the guide blades. It is therefore possible with the guide blades 1 according to the invention and the guide blade arrangement 20 according to the invention for an opening torque on the guide blades 1 to be generated over the entire operating range of the turbocharger, as a result of which the emergency running characteristics of the turbocharger are significantly improved. Furthermore, the regulating behavior of the turbocharger is improved owing to the fact that the guide blades 1 have a defined angular position over the entire operating range of the turbocharger.

Figure 4:
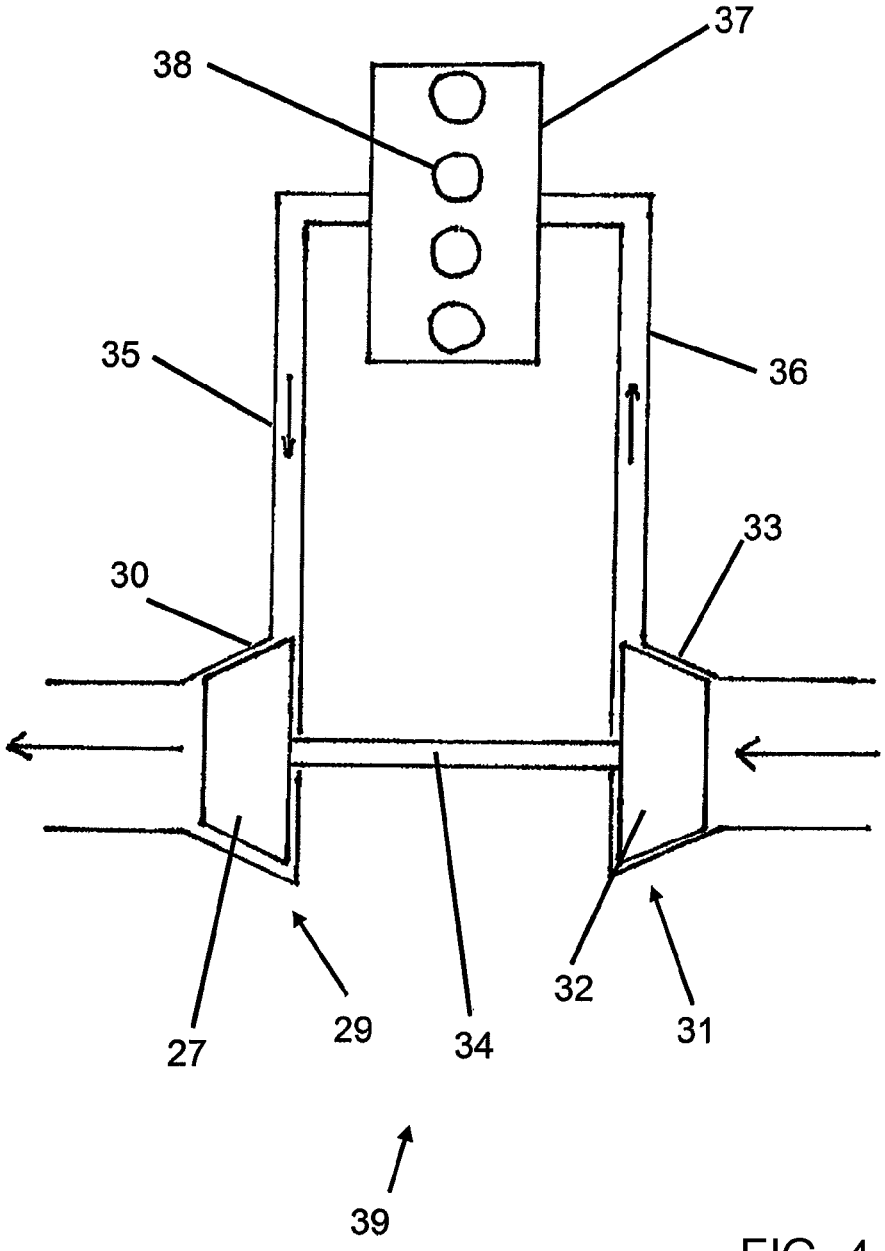
FIG. 4 shows a schematic view of an exemplary embodiment of an exhaust-gas turbocharger according to the invention.

FIG. 4 shows a schematic view of an exemplary embodiment of an exhaust-gas turbocharger according to the invention.

An internal combustion engine 37 with four cylinders 38 is fluidically coupled to the turbine wheel 27, which is situated in a turbine housing 30, of a turbine 29 of an exhaust-gas turbocharger 39 via an exhaust line 35. The turbine wheel 27 is connected in a rotationally conjoint manner to a compressor wheel 32 via a rotor shaft 34. The compressor wheel 32 is arranged in a compressor housing 33 of a radial compressor 31 of the exhaust-gas turbocharger 39. The compressor wheel 32 is fluidically coupled to the internal combustion engine 37 via an intake tract 36.

During operation of the internal combustion engine 37 with the exhaust-gas turbocharger 39, the internal combustion engine 37 provides exhaust gas to the turbine wheel 27 via the exhaust line 35. The turbine wheel 27 lowers the enthalpy of the exhaust gas and converts the kinetic and thermal energy of the exhaust gas into rotational energy. The rotational energy is transmitted via the rotor shaft 34 to the compressor wheel 32. The compressor wheel 32 sucks in fresh air, compresses it and conducts the compressed fresh air via the intake tract 36 to the internal combustion engine 37. Since more oxygen is provided per unit of volume in the compressed air volume, more fuel can be burned in the internal combustion engine 37 per unit of air volume. The power output of the internal combustion engine 37 is hereby increased.

By means of the guide blades according to the invention or the guide blade arrangement according to the invention, it is possible for the exhaust-gas turbocharger 39 and the internal combustion engine 37 to be operated with increased safety and reliability. Furthermore, it is possible by means of the guide blades according to the invention for the actuator required for adjusting the guide blades to be of smaller dimensions than in known solutions, because the guide blades have a self-opening effect and therefore a smaller force is needed to adjust them.

Although the present invention has been described entirely on the basis of preferred exemplary embodiments, it is not restricted to these, but rather may be modified in a variety of ways. In particular, features of the individual exemplary embodiments mentioned above may be combined with one another in any desired way, if this is technically expedient.

In a preferred modification of the present invention, the guide blade 1 has at least one cross-sectional constriction. This likewise makes it possible for a negative pressure to be generated on the blade surface. Since the cross section of the profile 3 of the guide blade 1 is constricted and not widened in a step-like manner, the profile thickness of the profile 3 can be reduced. The spatial requirement of the guide blade 1 is reduced in this way.

In a further preferred modification of the present invention, the guide blade 1 has at least two step-like cross-sectional widenings 13.

The materials, numerical values and dimensions specified are to be understood as examples and serve merely for explaining the embodiments and refinements of the present invention.

The specified guide blade, the specified guide blade arrangement and the specified turbocharger can be used particularly advantageously in the automotive field, and preferably in passenger motor vehicles, for example with diesel or applied-ignition engines, but may also be used in any other turbocharger applications if required.

The invention claimed is:

1. A guide blade for a turbocharger equipped with a variable turbine geometry, the guide blade comprising:

a guide blade profile having a blade underside, a blade top side, a blade leading edge, and a nose extending along said blade leading edge, said nose extending from said blade leading edge toward said blade top side and forming a negative pressure on said blade top side when exhaust gases impinge on the guide blade;

wherein said nose forms a step-like cross-sectional widening of said guide blade profile;

wherein said guide blade profile has a first curvature central point of a first head, a blade trailing edge, a second curvature central point of an end radius, and a profile central line defining a profile basic shape of the guide blade, said profile central line running from said first curvature central point of said first head radius in a region of said blade leading edge to said second curvature central point of said end radius in a region of said blade trailing edge situated opposite said blade leading edge;

wherein in a region of said nose, said guide blade profile has a third curvature central point of a second head radius disposed spaced apart from said profile central line, said third curvature central point is disposed such that said blade leading edge is formed by said first and the second head radii, said second head radius is greater than said first head radius; and wherein said third curvature central point is disposed between said profile central line and said blade top side.

2. The guide blade according to claim 1, wherein in a region of said step-like cross-sectional widening, said guide blade profile runs over said second head radius approximately perpendicular to said profile central line and merges into said profile basic shape.

3. The guide blade according to claim 1, wherein said profile central line is a straight line.

4. The guide blade according to claim 1, wherein said profile central line has a continuous curvature.

5. The guide blade according to claim 1, wherein said nose is disposed in a front third of said guide blade profile with respect to said blade leading edge.

6. The guide blade according to claim 1, wherein said nose has an end edge with a sharp-edged design.

7. The guide blade according to claim 1, wherein said nose has an extent, in a longitudinal direction of said guide blade profile proceeding from said blade leading edge, of up to 50% of a length of said guide blade profile.

8. The guide blade according to claim 1, wherein said nose has an extent, in a longitudinal direction of said guide blade profile proceeding from said blade leading edge, of up to 30% of a length of said guide blade profile.

9. The guide blade according to claim 1, wherein the guide blade is for a motor vehicle.

10. A guide blade configuration for a turbocharger with an adjustable turbine geometry, the guide blade configuration comprising:

a multiplicity of guide blades each containing a guide blade profile having a blade underside, a blade top side, a blade leading edge, and a nose extending along said blade leading edge, said nose extending from said blade leading edge toward said blade top side and forming a negative pressure on said blade top side when exhaust gases impinge on the guide blade;

a receptacle device for rotatably receiving said guide blades, said guide blades disposed in a circular configuration in said receptacle device and axes of rotation of said guide blades disposed parallel to one another;

an adjusting device for a uniform adjustment of an angle of incidence of said guide blades, said adjusting device being an adjusting ring;

an actuator for adjusting said adjusting ring; and a coupling for connecting said actuator to said adjusting ring;

wherein said nose forms a step-like cross-sectional widening of said guide blade profile;

wherein said guide blade profile has a first curvature central point of a first head, a blade trailing edge, a second curvature central point of an end radius, and a profile central line defining a profile basic shape of the guide blade, said profile central line running from said first curvature central point of said first head radius in a region of said blade leading edge to said second curvature central point of said end radius in a region of said blade trailing edge situated opposite said blade leading edge;

wherein in a region of said nose, said guide blade profile has a third curvature central point of a second head radius disposed spaced apart from said profile central line, said third curvature central point is disposed such that said blade leading edge is formed by said first and the second head radii, said second head radius is greater than said first head radius; and wherein said third curvature central point is disposed between said profile central line and said blade top side.

11. A turbocharger for a motor vehicle, comprising:

a turbine housing;

a turbine wheel disposed in said turbine housing, said turbine wheel having a guide blade configuration, said guide blade configuration containing:

a multiplicity of guide blades each containing a guide blade profile having a blade underside, a blade top side, a blade leading edge, and a nose extending along said blade leading edge, said nose extending from said blade leading edge toward said blade top side and forming a negative pressure on said blade top side when exhaust gases impinge on said guide blades;

a receptacle device for rotatably receiving said guide blades, said guide blades disposed in a circular configuration in said receptacle device and axes of rotation of said guide blades disposed parallel to one another;

an adjusting device for a uniform adjustment of an angle of incidence of said guide blades, said adjusting device being an adjusting ring;

an actuator for adjusting said adjusting ring; and a coupling for connecting said actuator to said adjusting ring;

a compressor housing;

a compressor wheel disposed in said compressor housing; and a rotor shaft connecting said turbine wheel to said compressor wheel in a rotationally conjoint manner, wherein an angle at which an exhaust-gas impinges on said turbine blade arrangement can be adjusted by adjusting an angle of incidence of said guide blades;

wherein said nose forms a step-like cross-sectional widening of said guide blade profile;

wherein said guide blade profile has a first curvature central point of a first head, a blade trailing edge, a second curvature central point of an end radius, and a profile central line defining a profile basic shape of the guide blade, said profile central line running from said first curvature central point of said first head radius in a region of said blade leading edge to said second curvature central point of said end radius in a region of said blade trailing edge situated opposite said blade leading edge;

wherein in a region of said nose, said guide blade profile has a third curvature central point of a second head radius disposed spaced apart from said profile central line, said third curvature central point is disposed such that said blade leading edge is formed by said first and the second head radii, said second head radius is greater than said first head radius; and wherein said third curvature central point is disposed between said profile central line and said blade top side.

12. A motor vehicle, comprising:

a turbocharger, containing:

a turbine housing;

a turbine wheel disposed in said turbine housing, said turbine wheel having a turbine blade configuration, said turbine blade configuration containing:

a multiplicity of guide blades each containing a guide blade profile having a blade underside, a blade top side, a blade leading edge, and a nose extending along said blade leading edge, said nose extending from said blade leading edge toward said blade top side and forming a negative pressure on said blade top side when exhaust gases impinge on said guide blades;

a receptacle device for rotatably receiving said guide blades, said guide blades disposed in a circular configuration in said receptacle device and axes of rotation of said guide blades disposed parallel to one another;

an adjusting device for a uniform adjustment of an angle of incidence of said guide blades, said adjusting device being an adjusting ring;

an actuator for adjusting said adjusting ring;

a coupling for connecting said actuator to said adjusting ring;

a compressor housing;

a compressor wheel disposed in said compressor housing; and a rotor shaft connecting said turbine wheel to said compressor wheel in a rotationally conjoint manner, wherein an angle at which exhaust-gases impinge on said turbine blade configuration can be adjusted by adjusting an angle of incidence of said guide blades;

wherein said nose forms a step-like cross-sectional widening of said guide blade profile;

wherein said guide blade profile has a first curvature central point of a first head, a blade trailing edge, a second curvature central point of an end radius, and a profile central line defining a profile basic shape of the guide blade, said profile central line running from said first curvature central point of said first head radius in a region of said blade leading edge to said second curvature central point of said end radius in a region of said blade trailing edge situated opposite said blade leading edge;

wherein in a region of said nose, said guide blade profile has a third curvature central point of a second head radius disposed spaced apart from said profile central line, said third curvature central point is disposed such that said blade leading edge is formed by said first and the second head radii, said second head radius is greater than said first head radius; and wherein said third curvature central point is disposed between said profile central line and said blade top side.

13. A method for operating a turbocharger having a multiplicity of guide blades each containing a guide blade profile having a blade underside, a blade top side, a blade leading edge, and a nose extending along the blade leading edge, the nose extending from the blade leading edge toward the blade top side and forming a negative pressure on the blade top side when exhaust gases impinge on the guide blade, which comprises the steps of:

wherein the multiplicity of guide blades are impinged on by a flow of exhaust gas in such a way that the exhaust gases impinge on a respective guide blade only in a region of the nose, as a result of which the negative pressure is formed in a region of the nose of each of the guide blades;

wherein said nose forms a step-like cross-sectional widening of said guide blade profile;

wherein said guide blade profile has a first curvature central point of a first head, a blade trailing edge, a second curvature central point of an end radius, and a profile central line defining a profile basic shape of the guide blade, said profile central line running from said first curvature central point of said first head radius in a region of said blade leading edge to said second curvature central point of said end radius in a region of said blade trailing edge situated opposite said blade leading edge;

wherein in a region of said nose, said guide blade profile has a third curvature central point of a second head radius disposed spaced apart from said profile central line, said third curvature central point is disposed such that said blade leading edge is formed by said first and the second head radii, said second head radius is greater than said first head radius; and wherein said third curvature central point is disposed between said profile central line and said blade top side.

* * * * *